US009566528B2

(12) United States Patent
Colquhoun

(10) Patent No.: US 9,566,528 B2
(45) Date of Patent: Feb. 14, 2017

(54) ROTATING TOP LAUNCHER

(71) Applicant: Mattel, Inc., El Segundo, CA (US)

(72) Inventor: Christian Colquhoun, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/044,324

(22) Filed: Oct. 2, 2013

(65) Prior Publication Data

US 2014/0094087 A1 Apr. 3, 2014

Related U.S. Application Data

(60) Provisional application No. 61/708,880, filed on Oct. 2, 2012.

(51) Int. Cl.
*A63H 1/02* (2006.01)
*A63H 29/24* (2006.01)

(52) U.S. Cl.
CPC ..... *A63H 1/02* (2013.01); *A63H 29/24* (2013.01)

(58) Field of Classification Search
CPC ..... A63H 17/008
USPC ..... 446/259, 429, 430, 63; 124/65
See application file for complete search history.

(56) References Cited

U.S. PATENT DOCUMENTS

| | | | |
|---|---|---|---|
| 33,284 | A | 9/1861 | Wright |
| 45,816 | A | 1/1865 | Cramer |
| 202,118 | A | 4/1878 | Raetz |
| 202,742 | A | 4/1878 | Mohr |
| 299,703 | A | 6/1884 | Volke |
| 387,761 | A | 8/1888 | Briggs |
| 458,483 | A | 8/1891 | Phipps |
| 561,492 | A | 6/1896 | Cluxton |
| 566,922 | A | 9/1896 | Maynard |
| 567,008 | A | 9/1896 | Segassie |
| 602,019 | A | 4/1898 | Steppan |
| 615,930 | A | 12/1898 | Warren |
| 643,026 | A | 2/1900 | Young |
| 706,676 | A | 8/1902 | Mann |
| 739,506 | A | 9/1903 | Purdum |

(Continued)

FOREIGN PATENT DOCUMENTS

| | | | |
|---|---|---|---|
| CN | 201120172 | Y | 9/2008 |
| FR | 2591905 | | 6/1987 |

(Continued)

OTHER PUBLICATIONS

International Search Report for Application No. PCT/US2013/043687: Date of Mailing: Sep. 12, 2013.

(Continued)

*Primary Examiner* — Michael Dennis
*Assistant Examiner* — Dolores Collins
(74) *Attorney, Agent, or Firm* — Edell, Shapiro & Finnan, LLC

(57) ABSTRACT

A top launcher includes at least one track segment having a guiding path for translating a rotatable top thereon. Also included is a launching member moveable between a first position and a second position, the launching member resiliently biased toward the first position. Further included is an engagement portion of the launching member for engaging the rotatable top and launching the rotatable top as the launching member moves toward the first position.

13 Claims, 4 Drawing Sheets

(56) References Cited

U.S. PATENT DOCUMENTS

| | | | | | |
|---|---|---|---|---|---|
| 809,270 | A | | 1/1906 | Phipps | |
| 823,809 | A | | 6/1906 | Powers | |
| 832,960 | A | | 10/1906 | Elbra | |
| 846,047 | A | | 3/1907 | Newman | |
| 847,933 | A | | 3/1907 | Gibbs | |
| 945,484 | A | | 1/1910 | Anderson | |
| 960,715 | A | | 6/1910 | Schneider | |
| 1,005,020 | A | | 10/1911 | Gibbs | |
| 1,060,612 | A | | 5/1913 | Mangelsdorff | |
| 1,099,615 | A | | 6/1914 | Purse | |
| 1,115,863 | A | | 11/1914 | Preyer | |
| 1,130,461 | A | | 3/1915 | Zolper | |
| 1,133,756 | A | | 3/1915 | Smith | |
| 1,208,975 | A | | 12/1916 | John | |
| 1,281,866 | A | * | 10/1918 | Stahl | 446/264 |
| 1,317,699 | A | | 10/1919 | Gibbs | |
| 1,364,632 | A | | 1/1921 | Harrington | |
| 1,368,040 | A | | 2/1921 | Lindstrom | |
| 1,915,475 | A | | 10/1922 | Gibbs | |
| 1,590,242 | A | | 6/1924 | Howard | |
| 1,499,803 | A | | 7/1924 | Cayo | |
| 1,570,206 | A | | 1/1926 | Connell | |
| 1,680,423 | A | | 8/1928 | Lindstrom | |
| 1,695,486 | A | | 12/1928 | Gibbs | |
| 1,959,635 | A | | 5/1934 | Moore | |
| 2,188,824 | A | | 1/1940 | Thigpen | |
| 2,375,986 | A | | 5/1945 | Gandy | |
| 2,534,538 | A | | 12/1945 | Thoresen | |
| 2,627,412 | A | | 6/1951 | Bronson | |
| 2,919,920 | A | | 6/1957 | Heape | |
| 2,892,287 | A | | 6/1959 | Weinstein | |
| 2,971,288 | A | | 7/1959 | Gill | |
| 2,940,362 | A | * | 6/1960 | Paxton | 89/1.806 |
| 2,949,694 | A | * | 8/1960 | Aye | 446/54 |
| 3,308,575 | A | | 3/1967 | Lemelson | |
| 3,318,600 | A | | 5/1967 | Glass et al. | |
| 3,408,766 | A | * | 11/1968 | Ajero | 446/255 |
| 3,410,022 | A | | 11/1968 | Behl | |
| 3,429,573 | A | | 2/1969 | Cederberg | |
| 3,451,161 | A | | 6/1969 | Lemelson | |
| 3,466,796 | A | | 9/1969 | Greenblatt | |
| 3,498,612 | A | | 3/1970 | Ellis | |
| 3,542,366 | A | | 11/1970 | Schoker | |
| 3,591,181 | A | | 7/1971 | Stewart | |
| 3,628,285 | A | | 12/1971 | Murakami | |
| 3,641,704 | A | | 2/1972 | Sims et al. | |
| 3,674,271 | A | | 7/1972 | De Gelder et al. | |
| 3,775,897 | A | | 12/1973 | Soulakis et al. | |
| 3,789,542 | A | | 2/1974 | Sims et al. | |
| 3,798,829 | A | * | 3/1974 | Worley | 446/51 |
| 3,815,911 | A | | 6/1974 | Cooper | |
| 3,905,350 | A | * | 9/1975 | Becker | 124/17 |
| 3,916,560 | A | * | 11/1975 | Becker | 446/62 |
| 3,937,191 | A | * | 2/1976 | Green | 124/57 |
| 3,952,442 | A | * | 4/1976 | Livesey et al. | 446/429 |
| 4,016,854 | A | | 4/1977 | Lehman | |
| 4,200,283 | A | | 4/1980 | Andrews et al. | |
| 4,248,426 | A | | 2/1981 | Sims et al. | |
| 4,251,949 | A | | 2/1981 | Buck et al. | |
| 4,267,661 | A | * | 5/1981 | Hanson | 446/430 |
| 4,286,406 | A | | 9/1981 | Sims et al. | |
| 4,408,413 | A | | 10/1983 | Hyland et al. | |
| 4,513,967 | A | | 4/1985 | Halford et al. | |
| 4,516,953 | A | | 5/1985 | Hippely et al. | |
| 4,531,923 | A | | 7/1985 | Lohr | |
| 4,538,999 | A | * | 9/1985 | Orlowski | 446/259 |
| 4,558,867 | A | | 12/1985 | Hippely | |
| 4,575,346 | A | | 3/1986 | Ogawa | |
| RE32,106 | E | | 4/1986 | Lemelson | |
| 4,605,230 | A | | 8/1986 | Halford et al. | |
| 4,690,658 | A | * | 9/1987 | Crosson et al. | 446/429 |
| 4,753,623 | A | | 6/1988 | Krut | |
| 4,772,241 | A | * | 9/1988 | Bro et al. | 446/202 |
| 4,795,396 | A | | 1/1989 | Lindstrom | |
| 4,867,728 | A | * | 9/1989 | Moomaw | 446/259 |
| 4,897,065 | A | * | 1/1990 | Fertig et al. | 446/63 |
| 4,932,918 | A | * | 6/1990 | Onoda | 446/260 |
| 4,961,577 | A | | 10/1990 | Gebert | |
| 4,964,637 | A | | 10/1990 | Gebert | |
| 4,982,961 | A | * | 1/1991 | Ichimura | 273/109 |
| 5,007,877 | A | | 4/1991 | Watson | |
| 5,024,625 | A | | 6/1991 | MacCarthy | |
| 5,026,057 | A | * | 6/1991 | Watford | 273/108.1 |
| 5,129,655 | A | | 7/1992 | Gillespie et al. | |
| 5,506,459 | A | | 4/1996 | Ritts | |
| 5,518,437 | A | | 5/1996 | Nonaka et al. | |
| 5,545,068 | A | | 8/1996 | Asbaghi | |
| D380,022 | S | | 6/1997 | Kusumi et al. | |
| D387,099 | S | | 12/1997 | Kusumi et al. | |
| 5,842,907 | A | * | 12/1998 | Niimura et al. | 446/435 |
| 5,971,830 | A | * | 10/1999 | Tobin | 446/256 |
| 6,089,946 | A | * | 7/2000 | Yang | 446/259 |
| 6,312,306 | B1 | | 11/2001 | Kroll | |
| 6,435,929 | B1 | | 8/2002 | Halford | |
| 6,485,017 | B1 | | 11/2002 | Ng | |
| 6,505,618 | B1 | * | 1/2003 | Ben-Hador | 124/16 |
| 6,604,978 | B1 | | 8/2003 | Abel | |
| 6,685,531 | B1 | | 2/2004 | Tiefel et al. | |
| 6,739,939 | B2 | | 5/2004 | Matsukawa | |
| 6,746,300 | B1 | | 6/2004 | Matsukawa | |
| 6,769,953 | B1 | * | 8/2004 | Sutton et al. | 446/256 |
| 6,773,328 | B2 | | 8/2004 | Tiefel et al. | |
| 6,793,151 | B2 | | 9/2004 | Kimbrough | |
| 6,905,389 | B2 | | 6/2005 | Matsukawa | |
| 6,913,506 | B2 | | 7/2005 | Tiefel et al. | |
| 6,913,508 | B2 | | 7/2005 | Hornsby et al. | |
| 7,018,263 | B2 | | 3/2006 | Tiefel et al. | |
| 7,275,974 | B2 | | 10/2007 | Perry | |
| 7,435,152 | B2 | | 10/2008 | Kimbrough | |
| 7,575,498 | B2 | | 8/2009 | Perry | |
| 7,686,002 | B2 | * | 3/2010 | Andrews | 124/65 |
| 7,895,995 | B2 | * | 3/2011 | Simon | 124/5 |
| 8,011,994 | B2 | * | 9/2011 | Fink et al. | 446/429 |
| 8,083,566 | B2 | | 12/2011 | Finlan | |
| 8,210,895 | B2 | * | 7/2012 | Bertrand et al. | 446/259 |
| 8,517,790 | B2 | * | 8/2013 | Rehkemper et al. | 446/259 |
| 8,556,676 | B2 | * | 10/2013 | Bertrand et al. | 446/259 |
| 8,568,191 | B2 | * | 10/2013 | Rehkemper et al. | 446/259 |
| 2005/0070203 | A1 | | 3/2005 | Beckett | |
| 2006/0258259 | A1 | | 11/2006 | Lin | |
| 2009/0197503 | A1 | | 8/2009 | Grosu | |
| 2011/0086574 | A1 | | 4/2011 | Nuttall et al. | |
| 2012/0088433 | A1 | | 4/2012 | Choe | |
| 2013/0012099 | A1 | * | 1/2013 | Nielsen | 446/256 |
| 2013/0239936 | A1 | * | 9/2013 | Victor et al. | 124/16 |
| 2013/0324005 | A1 | * | 12/2013 | Ferreyra et al. | 446/259 |

FOREIGN PATENT DOCUMENTS

| | | | |
|---|---|---|---|
| FR | 2614800 | A1 | 11/1988 |
| JP | 2008067919 | A | 3/2008 |
| RU | 66215 | U1 | 9/2007 |
| WO | 2010073080 | A2 | 7/2010 |

OTHER PUBLICATIONS

Written Opinion for Application No. PCT/US2013/043687: Date of Mailing: Sep. 12, 2013.
English Translation for JP2008067919A.
English Translation for CN201120172Y.

* cited by examiner

ROTATING TOP LAUNCHER

CROSS REFERENCE TO RELATED APPLICATIONS

This application claims the benefit of U.S. Provisional Patent Application Ser. No. 61/708,880 filed Oct. 2, 2012, the contents of which are incorporated herein by reference thereto.

BACKGROUND

Various embodiments of the present invention are related to toy play sets, and more particularly to rotating top assemblies, as well as a method for launching rotating tops.

Toy play sets having tracks for guiding objects have achieved propulsion and guidance of the objects in various manners. Objects, such as race cars or trains, for example, have translated along a predetermined path by an included motor for generating the propelling force. Alternatively, some objects have relied upon a magnetic field for accelerating and guiding the object. Various movement initiator arrangements have been provided to launch objects and have added to enjoyment of users of the toy play sets. Unfortunately, the launchers often lack reliability and pose issues with stability of the launched object upon movement initiation.

Accordingly, it is desirable to provide a rotating top launcher that provides reliable and exciting initiation of movement for the rotating tops.

SUMMARY OF THE INVENTION

In one embodiment, a top launcher includes at least one track segment having a guiding path for translating a rotatable top thereon. Also included is a launching member moveable between a first position and a second position, the launching member resiliently biased toward the first position. Further included is an engagement portion of the launching member for engaging the rotatable top and launching the rotatable top as the launching member moves toward the first position.

In another embodiment, an electrically powered top launcher includes a magnetic engagement region for engaging and retaining a rotatable top. Also included is a detachment structure disposed adjacent the magnetic engagement region for detaching the rotatable top from the magnetic engagement region. Further included is a user actuator for initiating rotation of the rotatable top with the magnetic engagement region and detaching the rotatable top with the detachment structure.

In yet another embodiment, a top launcher is provided. The top launcher having: at least one track segment having a guiding path for translating a rotatable top thereon, the guiding path including a portion of a track sidewall; a launching member pivotally mounted to the at least one track segment for movement between a first position and a second position, the launching member resiliently biased toward the first position; and an engagement portion of the launching member for engaging a portion of the rotatable top between the engagement portion and the track sidewall as the launching member moves between the first position and the second position.

DETAILED DESCRIPTION

Figure 1:
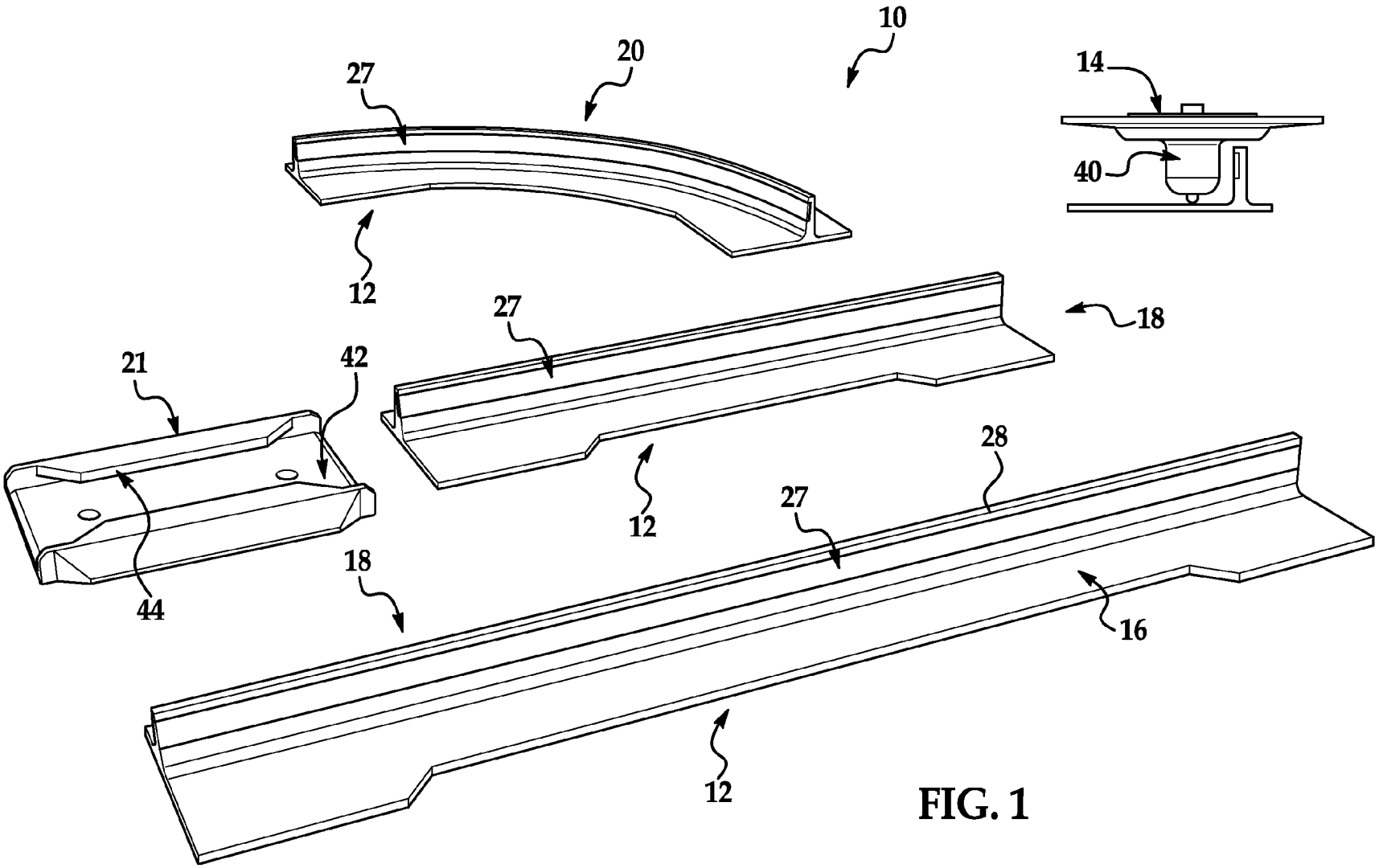
FIG. 1 is a perspective view of a plurality of track segments of a toy play set.

Referring now to FIG. 1, a rotating top assembly toy play set 10 includes at least one track segment 12 configured to guide a rotatable top 14 along a guiding path 16. Movement of the rotatable top 14 along the guiding path 16 is achieved by imposition of a sufficient magnetic attraction between at least one magnetic member 27 disposed within the rotatable top and either within or on the at least one track segment 12 as well as a rotational force applied to the top. The at least one magnetic member 27 may comprise a washer 40 disposed at an interior location of the rotatable top 14. The washer 40 may be disposed above and/or below the at least one magnetic member 27 within the rotatable top 14 to provide further magnetic attraction to the at least one track segment 12. General configurations and operation of the rotating top assembly toy play set 10 is described in detail in U.S. patent application Ser. No. 61/654,428, filed on Jun. 1, 2012 and U.S. patent application Ser. No. 13/907,307, the contents, in their entirety, each of which are incorporated herein by reference thereto.

As will be described in detail below, a top launcher 100 initiates movement of the rotatable top 14 via application of a rotational force thereto. Upon generation of stable rotation, the rotatable top 14 begins translational movement along the at least one track segment 12 and may include any number of geometries that define the guiding path 16. For example, the guiding path 16 may include one or more straightaways 18 and/or curved portions 20, with the at least one track segment 12 comprising a variety of dimensions, such as length, height and radius of curvature. Additionally, the at least one track segment 12 may comprise a plurality of track sections that may be fitted together with one or more track connectors 21 to form a variety of unique guiding paths 16. Each of the one or more track connectors 21 includes a base portion 42 and an upwardly extending hook portion 44 configured to engage and retain the at least one track segment 12.

Irrespective of the precise guiding path 16 formed by the at least one track segment 12, the rotatable top 14 is translated thereon. The translational movement results from conversion of the rotational movement of the rotatable top 14 to the translational movement along the guiding path 16. Additionally, the rotatable top 14 is magnetized by inclusion of a magnetic portion, either within or on, the rotatable top 14. Such a magnetized portion may comprise a magnetized rod or segment disposed centrally within the rotatable top 14. Alternatively, a surface of the rotatable top 14 may comprise or be coated with a magnetic material. Regardless of the portion of the rotatable top 14 that is magnetized, the rotatable top 14 is configured to magnetically interact with the at least one track segment 12 to accelerate and guide the rotatable top 14 along the guiding path 16 in a translational manner. As noted above, magnetic interaction between the rotatable top 14 and the at least one track segment 12 is achieved by disposition of the at least one magnetic member 27, either within or on, the at least one track segment 12. The at least one magnetic member 27 may be integrally formed or operably coupled to the at least one track segment 12, and more specifically to a track sidewall 28 and/or a guide path surface. Enhanced magnetic attraction between the rotatable top 14 and the at least one track segment 12 is achieved by disposition of the at least one magnetic member 27 on both sides of the track sidewall 28.

An exemplary embodiment of the at least one magnetic member 27 comprises a ferromagnetic material. The term "ferromagnetic material" for purposes of this description typically refers to materials that are strongly magnetically attracted to magnets, such as the magnetic portion disposed within or on the rotatable top 14, and have the capacity to strengthen the magnetic field in different parts of a magnetic circuit. The ferromagnetic material disposed within or on the at least one track segment 12 propels and attracts the rotatable top 14 by interaction with the polarization of the magnetic portion within or on the rotatable top 14.

Figure 2A:
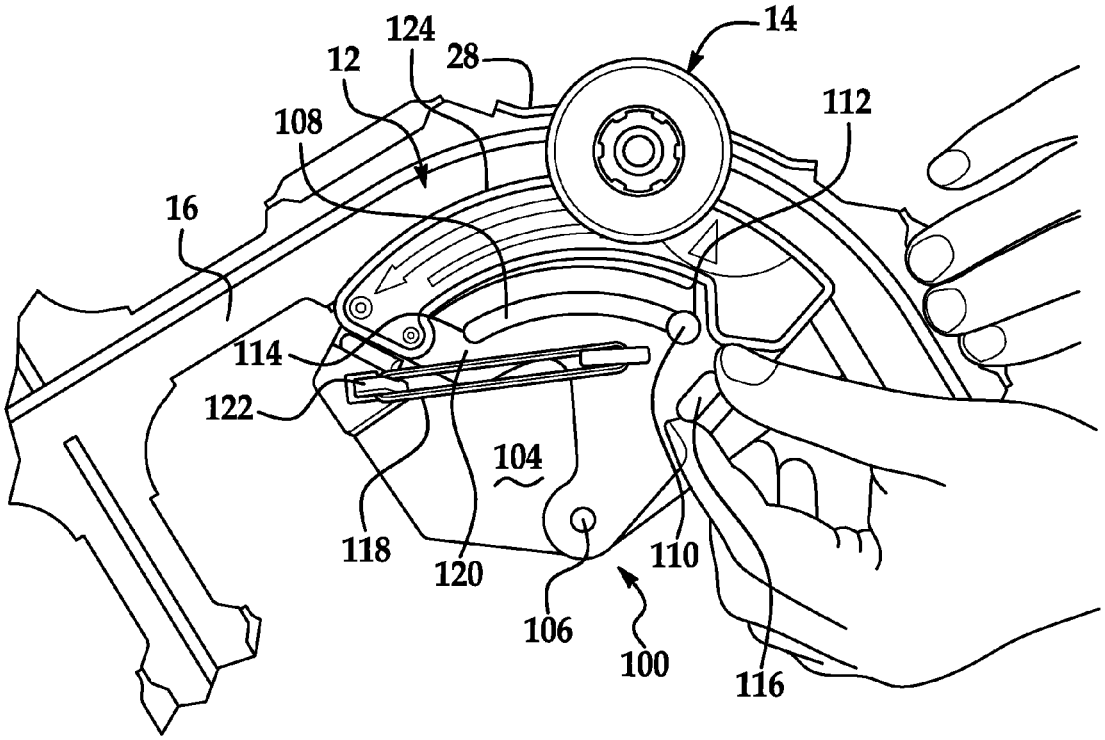
FIG. 2A is a top plan view of the top launcher in a first position according to a first embodiment.
Figure 2B:
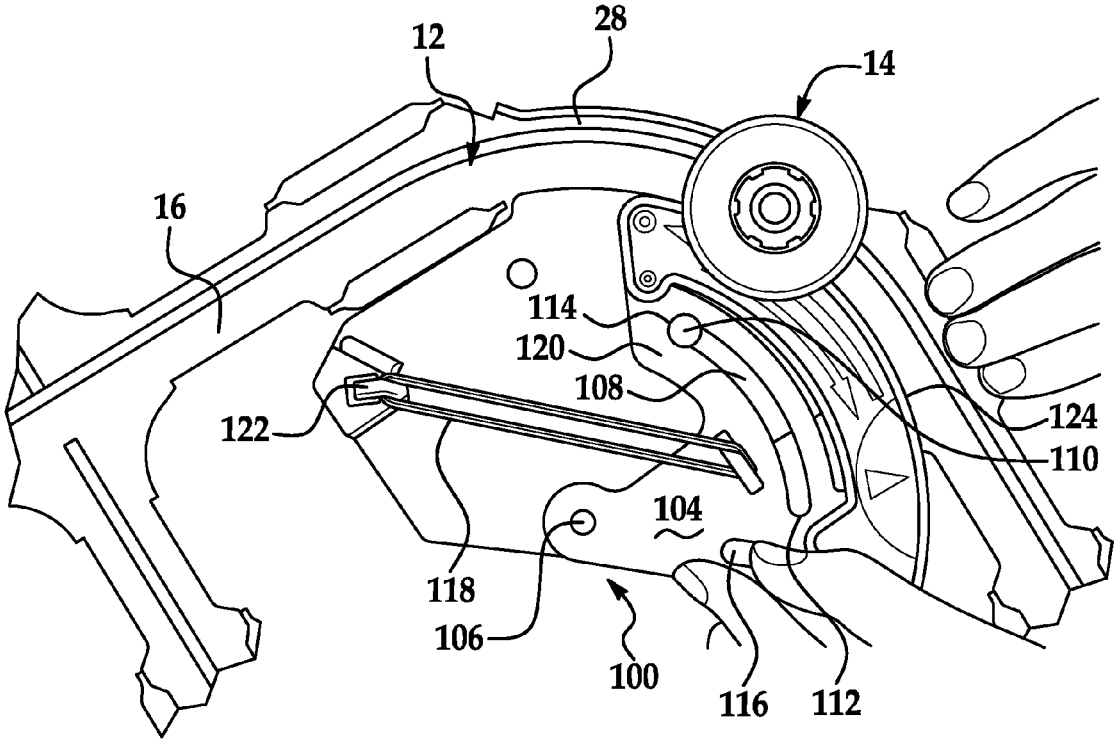
FIG. 2B is a top plan view of the top launcher in a second position according to the first embodiment of FIG. 2A.

Referring now to FIGS. 2A and 2B, the top launcher 100 is illustrated according to a first embodiment. As shown, top launcher 100 is disposed in close proximity to the at least one track segment 12, and more particularly in close proximity to the guiding path 16. It is contemplated that the top launcher 100 may be integrally formed with the at least one track segment 12 or is a portable member that may be employed to launch the rotatable top 14 from numerous locations along the at least one track segment 12.

In one non-limiting exemplary embodiment, the top launcher 100 includes a launching member 102 that is pivotably coupled to a base portion 104 at a pivot location 106, thereby defining a curved path of movement for the launching member 102. However, it is to be appreciated that the launching member 102 may be coupled to the base portion 104 in a translational manner to define a linear path of movement for the launching member 102. Irrespective of the precise path of movement, the launching member 102 includes a slot 108 configured to receive and retain at least one protrusion 110 extending away from the base portion 104 and into the slot 108. The at least one protrusion 110 guides the launching member 102 as the slot 108 moves relative to the at least one protrusion 110. The launching member 102 is shown in a first position (FIG. 2A) corresponding to positioning of the at least one protrusion 110 at a first end 112 of the slot 108. The launching member 102 is moveable to a second position (FIG. 2B) corresponding to positioning of the at least one protrusion 110 at a second end 114 of the slot 108. Movement of the launching member 102 may be facilitated by a user handle 116 configured to allow a user to grip the launching member 102 and move the launching member 102 away from the first position toward the second position.

A resilient member 118, such as a spring or elastic member, is retained by a first retaining member 120 extending from the launching member 102 and a second retaining member 122 extending from the base portion 104. Both the first retaining member 120 and the second retaining member 122 may be hook-like members spaced to maintain a relaxed condition of the resilient member 118 when the launching member 102 is in the first position and in a tension condition of the resilient member 118 when the launching member 102 is in the second position. Therefore, as the launching member 102 is manipulated by a user from the first position toward the second position, the resilient member 118 increases in tension and reaches a maximum tension at the second position, and more specifically when the at least one protrusion 110 reaches the second end 114 of the slot 108.

The launching member 102 also includes an engagement portion 124 configured to engage the rotatable top 14. The rotatable top 14 is positioned between the engagement portion 124 and the track sidewall 28. The close proximity to the track sidewall 28 results in a stable positioning of the rotatable top 14 based on the magnetic attraction between the rotatable top 14 and the at least one magnetic member 27 disposed on or in the track sidewall 28. Enhanced stability may be achieved with additional magnetic material disposed on or within the engagement portion 124 of the launching member 102. The launching member 102, and more specifically the engagement portion 124 draws the rotatable top 14 with the launching member 102 as movement between the first position and the second position is conducted. Once the launching member 102 reaches the second position, or an intermediate position between the first position and the second position, the launching member 102 is released by the user and is biased back toward the first position. During movement of the launching member 102 toward the first position, the rotatable top 14 is rotated and translated along the guiding path 16 and launched from the top launcher 100.

Figure 3A:
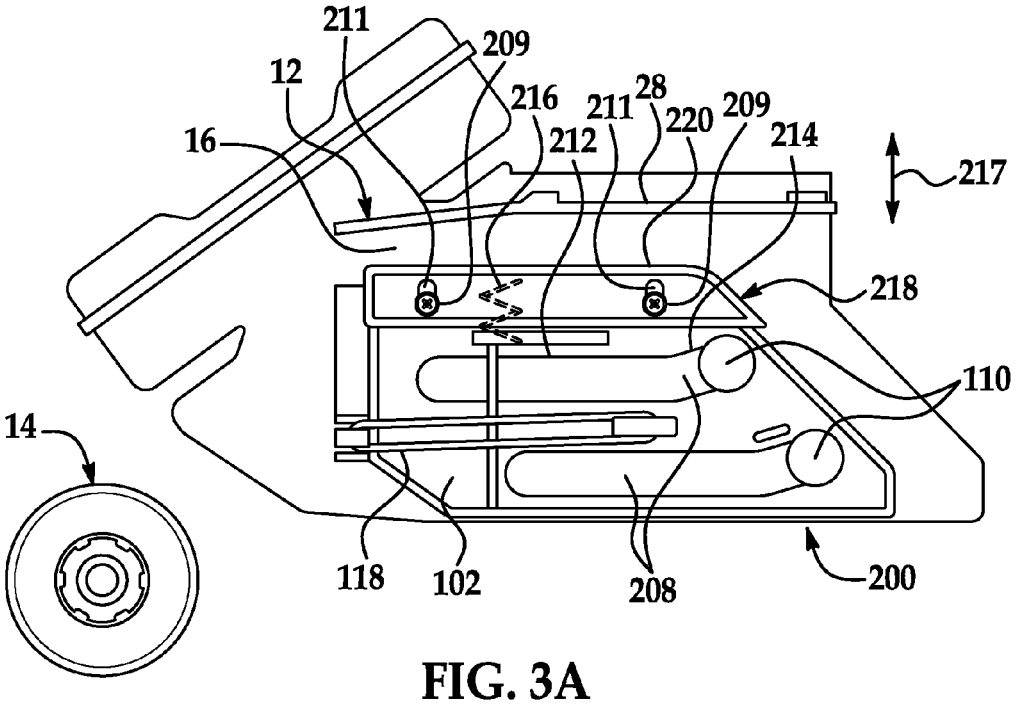
FIG. 3A is a top plan view of a top launcher in a first position according to a second embodiment.
Figure 3B:
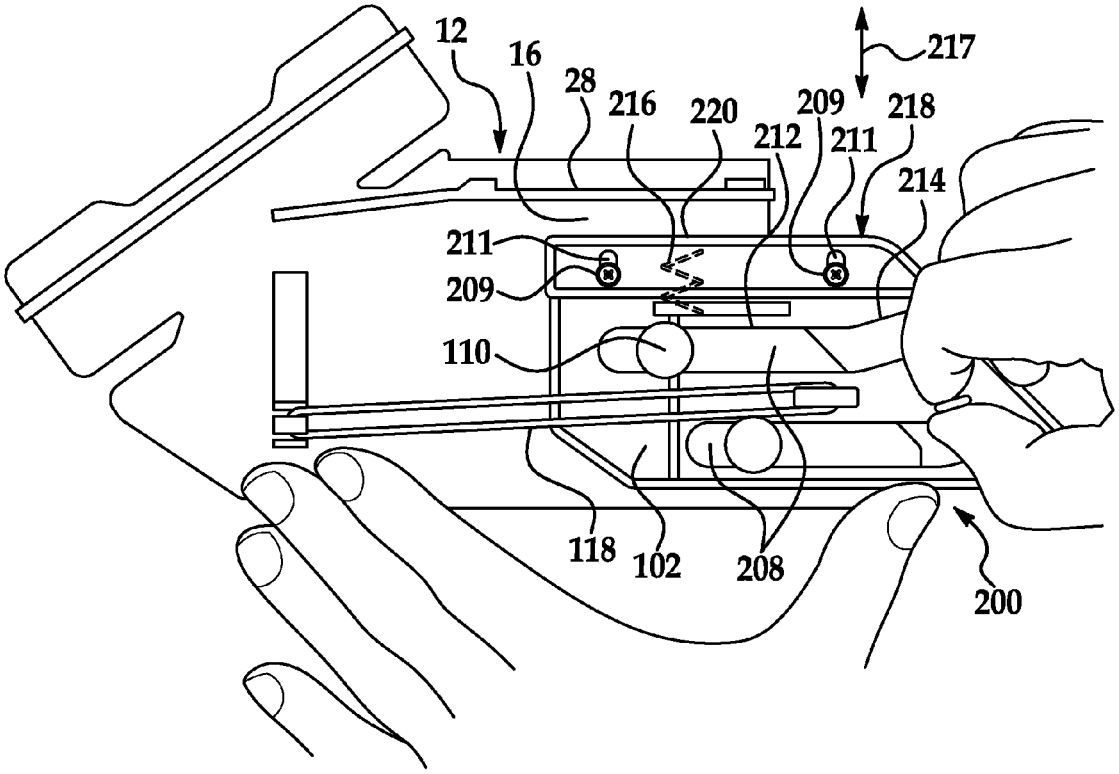
FIG. 3B is a top plan view of the top launcher in a second position according to the second embodiment of FIG. 3A.

Referring now to FIGS. 3A and 3B, a top launcher according to a second embodiment is illustrated and generally referred to with numeral 200. The second embodiment of the top launcher 200 is similar in many respects to that of the first embodiment, such that each component need not be discussed in further detail or repetitively. Where applicable, similar reference numerals used to describe the first embodiment may be employed. As with the first embodiment, the launching member 102 is moveable between a first position (FIG. 3A) and a second position (FIG. 3B), is guided by at least one protrusion 110 within the slot 108, and is resiliently biased toward the first position with the resilient member 118.

In the second embodiment, typically a plurality of slots 208 are present, with each of the plurality of slots 208 being receiving at least one protrusion 110. Each of the plurality of slots 208 includes a first portion 212 and a second portion 214. The first portion 212 is aligned in a relatively linear manner and the second portion 214 is aligned at an angle to the first portion 212. The alignment of the second portion 214 relative to the first portion 212 provides a cam for moving the launcher member 102 and a top engaging section 218 of the launching member 102 toward the track sidewall 28 for engaging the rotatable top 14 disposed on the guiding path 16 of the at least one track segment 12 when it is in the second position and away from the sidewall 28 as it moves to the first position thus, launching the top 14 therefrom. In this embodiment, the top engaging member 218 is movably secured to the launching member 102 by for example a pair of posts 209 slidably received within openings 211.

The top engaging section 218 is movably secured to launching member 102 of the top launcher 200 for movement in the direction of arrows 217 and as mentioned above the launching member 102 is movably secured to the top launcher for movement between the first and second positions. The top engaging section 218 is biased toward the track sidewall 28 with a spring 216 or other equivalent biasing member. In the illustrated embodiment, the spring 216 is disposed between the top engaging section 218 and a base member of the top launching member 102 or top launching member 102 itself, such that the top engaging section 218 is biased toward a portion of the rotatable top 14 and the portion is snugly engaged between a surface 220 of the top engaging section 218 and the track sidewall 28 as the top launching member 102 of the top launcher 200 moves between the first and second positions. The spring biasing of the top engaging section 218 towards the sidewall 28 allows the surface 220 of the top engaging section 218 to engage a portion of the rotatable top 14 therebetween but also allows some flexibility or independent movement of engaging section 218 as the top launching member 102 moves between the first and second positions thereby preventing a binding situation wherein movement of the top launching member 102 is prevented. Accordingly, the movable securement of the top engaging section 218 to the launching member 102 allows for enhanced top launching from launcher 200 as the top engaging section 218 is movably secured to the launching member 102 which in itself is movably secured to the launcher 200.

The movement of the launching member 102 toward the track sidewall 28 during movement from the first position toward the second position facilitates engagement with the rotatable top 14 disposed in magnetic attraction with the track sidewall 28. Similar to the first embodiment, as the launching member 102 of the rotating top launcher 200 is biased toward the first position upon release by the user, the rotatable top 14 is rotated and translated along the guiding path 16 for launching therealong.

Figure 4:
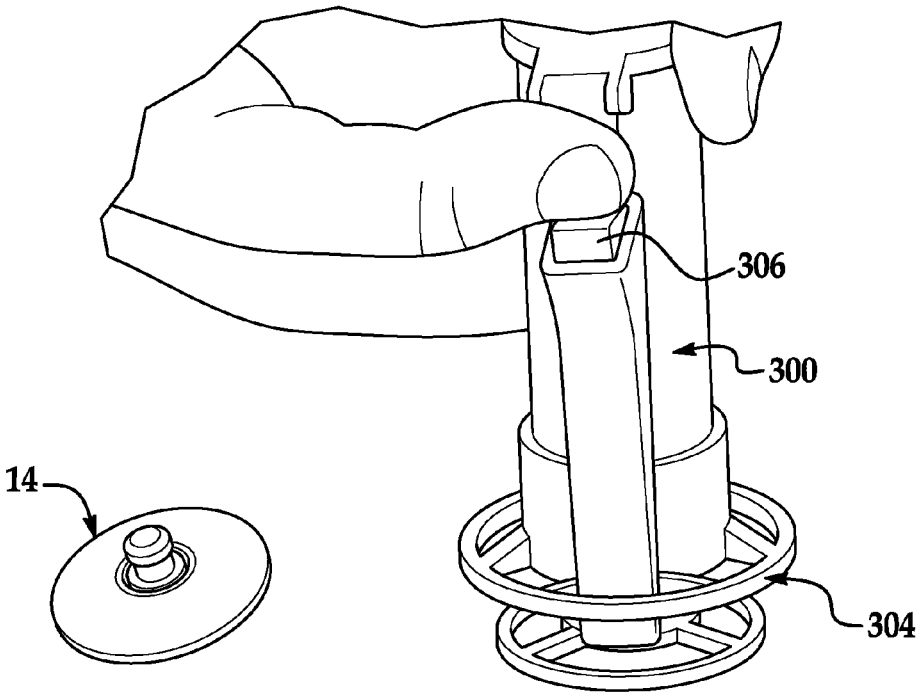
FIG. 4 is a perspective view of an electrically powered launcher.
Figure 5A:
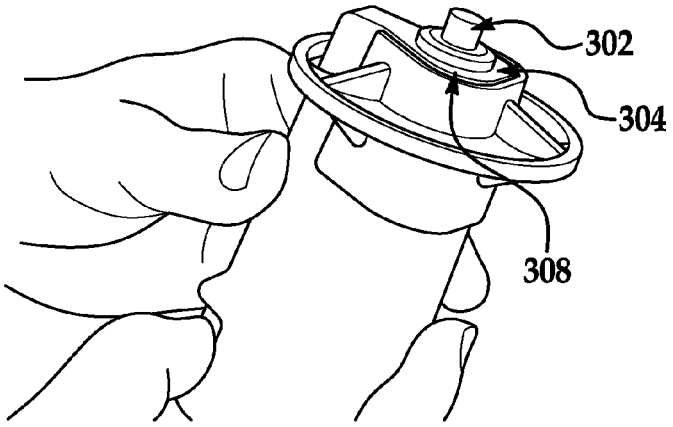
FIG. 5A is a perspective view of an engagement portion in a first position of the electrically powered launcher of FIG. 4.
Figure 5B:
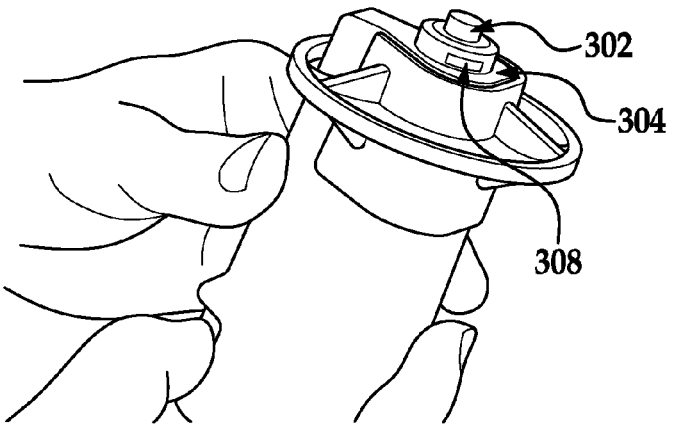
FIG. 5B is a perspective view of the engagement portion in a second position.

Referring to FIGS. 4, 5A and 5B, an electrically powered launcher 300 is illustrated. A magnetic engagement region 302 is disposed proximate an end 304 of the electrically powered launcher 300 for engaging the rotatable top 14 and retaining the rotatable top 14 proximate the end 304. The magnetic engagement region 302 may be configured as a protrusion extending onto or into a portion of the rotatable top 14. The magnetic attraction between the magnetic engagement region 302 and the rotatable top 14 provides a secure attachment of the rotatable top 14 with the electrically powered launcher 300.

The electrically powered launcher 300 also includes a user actuator 306, such as a trigger, configured for user control of the rotatable top 14. Specifically, based on the secure attachment of the magnetic engagement region 302 and the rotatable top 14, the rotatable top rotates with the magnetic engagement region 302 as a motor (not illustrated) within the electrically powered launcher 300 drives the magnetic engagement region 302 in a rotatable manner. The user may actuate such rotation by depressing the user actuator 306. In one embodiment, the user actuator 306 is a dual or two-step trigger, where partial depression of the trigger to a first actuating position results in actuation of rotation of the magnetic engagement region 302 and therefore the rotatable top 14 attached thereto, as shown in FIG. 5A. Complete depression of the trigger to a second actuation position provides a second initiation of the electrically powered launcher 300. The second initiation is an extension of a detachment structure 308 disposed adjacent to the magnetic engagement region 302, and in one embodiment the detachment structure 308 is a sleeve-like member disposed outwardly of the magnetic engagement region 302, as shown in FIG. 5B. In the exemplary embodiment, the magnetic engagement region 302 comprises a solid cylindrical geometry and the detachment structure 308 comprises a hoop surrounding the cylindrical geometry of the magnetic engagement region 302. Although illustrated and described with the circular, or cylindrical, geometries above, it is to be understood that the magnetic engagement region 302 and the detachment structure 308 may be formed in numerous suitable geometries.

Regardless of the precise geometry of the magnetic engagement region 302 and the detachment structure 308, it can be appreciated that upon complete depression of the user actuator 306, extension of the detachment structure 308 occurs to a position for breaking the attachment between the rotatable top 14 and the magnetic engagement region 302. Upon extension of the detachment structure 308, the rotatable top 14 is released onto the guiding path 16 of the at least one track segment 12 for movement thereon. As the rotatable top 14 is already rotating prior to detachment, the rotatable top 14 is effectively launched from the electrically powered launcher 300 and movement is initiated upon release onto the guiding path 16.

It is to be understood that the electrically powered launcher 300 may be powered by any suitable electrical source, such as a battery disposed within the electrically powered launcher 300 or via connection to an electrical outlet, for example. The electrically powered launcher 300 is typically portable, such that a user may launch the rotatable top 14 from numerous locations of the at least one track segment 12.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A top launcher comprising: at least one track segment having a guiding path for translating a rotatable top thereon in a first direction; a launching member moveably secured to the at least one track segment for movement between a first position and a second position, the launching member resiliently biased toward the first position; and an engagement portion of the launching member engaging a peripheral portion of the rotatable top between the engagement portion of the launching member and a portion of the track segment, rotating the rotatable top about an axis of rotation, and launching the rotatable top in the first direction as the launching member moves toward the first position from the second position, wherein the first direction is perpendicular to the axis of rotation.

2. The top launcher of claim 1, wherein the rotatable top includes a magnetized portion, wherein at least a portion of the at least one track segment includes a ferromagnetic material configured to guide the rotatable top along the guiding path of the at least one track segment.

3. The top launcher of claim 1, wherein the launching member further comprises a pair of elongated openings each being configured to slidably receive a protrusion therein as the launching member moves between the first and second positions.

4. The top launcher of claim 1, further comprising at least one protrusion disposed within at least one slot of the launching member for guiding the launching member between the first position and the second position.

5. The top launcher of claim 4, wherein the at least one slot includes a first portion and a second portion aligned at an angle to the first portion.

6. The top launcher of claim 3, wherein the pair of elongated openings each have a first portion linearly aligned with a sidewall of the at least one track segment and a second portion angularly aligned with the sidewall, wherein the second portion is configured to move the launching member away from the sidewall as the launching member moves between the first and second positions and wherein the engagement portion of the launching member is movably secured the launching member for independent movement with respect to the launching member as the launching member moves between the first and second positions.

7. The top launcher of claim 1, wherein the engagement portion of the launching member is movably secured the launching member for independent movement with respect to the launching member as the launching member moves between the first and second positions.

8. A top launcher, comprising:

at least one track segment having a guiding path for translating a rotatable top thereon in a first direction, the guiding path including a portion of a track sidewall;

a launching member pivotally mounted to the at least one track segment for movement between a first position and a second position, the launching member resiliently biased toward the first position; and an engagement portion of the launching member engaging a portion of the rotatable top, the portion of the rotatable top being trapped between the engagement portion of the launching member and the track sidewall as the launching member moves between the first position and the second position, the engagement portion rotating the rotatable top about an axis of rotation, and launching the rotatable top in the first direction as the launching member moves toward the first position from the second position, wherein the first direction is perpendicular to the axis of rotation.

9. The top launcher of claim 8, wherein the rotatable top includes a magnetized portion, wherein at least a portion of the track sidewall includes a ferromagnetic material configured to guide the rotatable top along the guiding path of the at least one track segment.

10. The top launcher of claim 8, wherein the launching member is curved in shape and the sidewall and the engagement portion remain parallel to each other as the launching member moves between the first position and the second position.

11. The top launcher of claim 10, wherein the rotatable top includes a magnetized portion, and wherein at least a portion of the track sidewall or the engagement portion includes a ferromagnetic material configured to guide the rotatable top along the guiding path of the at least one track segment.

12. The top launcher of claim 8, further comprising at least one protrusion disposed within at least one slot of the launching member for guiding the launching member between the first position and the second position.

13. The top launcher of claim 12, wherein the launching member is curved in shape and the sidewall and the engagement portion remain parallel to each other as the launching member moves between the first position and the second position.

* * * * *